US007124887B2

(12) United States Patent
Reimers

(10) Patent No.: US 7,124,887 B2
(45) Date of Patent: Oct. 24, 2006

(54) EXTENSION HANDLE AND GOLF BAG WITH EXTENSION HANDLE

(75) Inventor: Eric W. Reimers, Missoula, MT (US)

(73) Assignee: Sun Mountain Sports, Inc., Missoula, MT (US)

( * ) Notice: Subject to any disclaimer, the term of this patent is extended or adjusted under 35 U.S.C. 154(b) by 0 days.

(21) Appl. No.: 10/390,089

(22) Filed: Mar. 14, 2003

(65) Prior Publication Data

US 2004/0178093 A1 Sep. 16, 2004

(51) Int. Cl.
*A63B 55/00* (2006.01)
*A63B 55/04* (2006.01)

(52) U.S. Cl. ..... 206/315.3; 206/315.7

(58) Field of Classification Search ..... 206/315.3, 206/315.7; 190/715; 280/DIG. 6; 294/58
See application file for complete search history.

(56) References Cited

U.S. PATENT DOCUMENTS 1,693,889 A * 12/1928 Dick ..... 248/96
1,868,979 A * 7/1932 Hotze ..... 224/613
1,920,581 A * 8/1933 Murphy et al. ..... 248/96
2,008,759 A * 7/1935 Howard ..... 224/613
2,016,967 A * 10/1935 Komers ..... 248/96
2,091,298 A * 8/1937 Patterson ..... 206/315.2
2,422,315 A * 6/1947 Robinson ..... 206/315.7
2,437,405 A * 3/1948 Robinson ..... 294/137
2,475,454 A * 7/1949 Merrill ..... 280/645
2,482,372 A * 9/1949 Rossow ..... 206/315.2
2,602,676 A * 7/1952 Fieldhouse ..... 280/47.12
2,661,174 A * 12/1953 Sands ..... 248/96
2,786,693 A * 3/1957 Ayers ..... 280/47.26
3,014,750 A * 12/1961 Briggs ..... 294/58
3,425,708 A * 2/1969 Sato ..... 280/47.19
3,708,004 A * 1/1973 Seibold ..... 206/315.6
3,883,150 A * 5/1975 Varela ..... 280/47.19
4,152,003 A * 5/1979 Reineccius et al. ..... 280/47.18
4,685,561 A * 8/1987 Reimers ..... 206/315.6
4,735,425 A * 4/1988 Hoff ..... 280/47.18
4,792,152 A 12/1988 Carolan
4,794,667 A * 1/1989 Nelson et al. ..... 16/426
5,474,176 A * 12/1995 Schenkkan ..... 206/315.7
5,499,761 A 3/1996 Reimers
5,566,870 A 10/1996 Majeur
5,904,326 A * 5/1999 Riu ..... 248/96
6,199,690 B1 3/2001 Shin
6,231,059 B1 5/2001 Cheldin
6,296,116 B1 * 10/2001 Schmidt et al. ..... 206/315.7
6,491,197 B1 * 12/2002 Walker ..... 224/613

OTHER PUBLICATIONS

TheFreeDictionary.com definition of fix.*

* cited by examiner

*Primary Examiner*—Tri Mai
(74) *Attorney, Agent, or Firm*—Michael J. Hughes; Barry B. Guernsey; Intellectual Property Law Offices

(57) ABSTRACT

Briefly, one preferred embodiment of the present invention (10) is an extension handle (26) for a golf bag (12) having a top opening (19), and carrying straps (22). The extension handle (26) includes one or more brackets (28) attached to the golf bag (12) near the top opening (19), the brackets (28) having attachment points (48) for attachment of the golf bag straps (22), these attachment points (48) extending beyond the top opening (19) of the bag (12). The extension handle (26) includes a handle (36) attached to the bracket or brackets (28). Also a golf bag (10) having an extension handle (26).

5 Claims, 10 Drawing Sheets

EXTENSION HANDLE AND GOLF BAG WITH EXTENSION HANDLE

TECHNICAL FIELD

The present invention relates generally to golfing equipment and more particularly to a handle for manipulating a golf bag.

BACKGROUND ART

Golf is a game in which obtaining exercise is one of many goals, but in which its practitioners generally like to avoid discomfort. As golf can be practiced by people of many ages and physical conditions, it is important that carrying the golf clubs around the course not be perceived as burdensome. In an effort to make carrying the bag of golf clubs as easy as possible, many types of straps have been produced to improve the comfort of the user. The first types of straps used were generally single straps that extended from the bottom or foot of the golf bag to somewhere around the top of the bag. This was of course an improvement over carrying the bag by hand, and left the user's hands free.

The dual or double strap system has several advantages over the single strap because the weight is divided between the two straps, thus causing less stress on each of the shoulders. Several U.S. patents have been involved with this dual strap concept. Among them are U.S. Pat. Nos. 5,038,984, 5,042,703 and 5,042,704 to Izzo, U.S. Pat. No. 5,348,205 to Steurer and U.S. Pat. No. 5,636,778 to Jones. (X strap by Reimers) Each of these makes an attempt to improve the balance and/or weight distribution of the golf bag to improve the user of the user who is carrying the bag. Crucial considerations in the balance of the bag are the placement of the strap mounting points.

The stability of the bag as the user walks about is also of concern. A bag that bounces or swings excessively is undesirable, as this type of motion can be very tiring, as well as possibly annoying. Users of prior golf bags often are seen holding the ends of the bag to minimize motion. This of course defeats the objective of allowing the user to have his hands free while the straps carry the bag. One cause of this swinging motion and accompanying fatigue is the misalignment of the center of gravity of the bag compared to the center of gravity of the user. This is illustrated in FIG. 2 (prior art) and is partially caused by the positioning of the attachment points of the straps on the bag. This misplacement of the center of gravity of the bag could be corrected by using a longer bag, but this would increase weight and "swallow" clubs with short handles instead of leaving both short and long clubs visible.

Golfers routinely mount and dismount their golf bags from their backs in order to access their clubs. As the bag is slung across their backs in a generally horizontal orientation, it is the common practice for the golfers to reach around behind themselves to grasp whatever portion of the bag is reachable by their hands to swing the bag into an upright position while they shrug their way out of the straps. Bags are generally set up so that the opening at the bag's top is located on the right hand side of a right-handed user, so that the right hand may reach back and grasp a portion of the bag. This is usually done by using the "goose neck grip", as it has been called, to insert the user's fingers into the bag opening and then pinch with the thumb to grasp the upper portion of the golf bag. This grip is shown in FIG. 3 (prior art), and involves an awkward and potentially painful contortion where the user must pull his elbow as far as possible behind him, arch his wrist to a nearly painful degree, and then attempt to grasp the bag's opening and support it, which may weigh as much as 35 lbs when loaded, in this goose neck grip, while struggling out of the straps.

Additionally, the goose neck grip requires that the user insert their fingers into the upper compartment of the bag when grasping it, which may be difficult if this compartment is already filled with clubs. In this case, the user may have to grab the straps for guidance, turning the dismounting process into a two-handed operation, with additional contortions. This is even more awkward in cases where the bag has a built-in stand which the user must activate, as the user may then have to temporarily stand the bag vertically, re-grip it and then tilt it and push downward to activate the stand.

Thus there is a need for a golf bag which is more stable, involving very little swing or bounce, which distributes the weight of the bag on the shoulders well and has improved balance. There is also a need for a golf bag which is easier to mount and dismount than those currently in use.

DISCLOSURE OF INVENTION

An object of the present invention is to provide an extended handle for a golf bag so that the golf bag is easier to mount and dismount than those currently in use.

Another object of the invention is to present an extension handle which provides an extended attachment point for straps so that the golf bag has improved balance and weight distribution.

And another object of the invention is to present an extension handle which provides an extended attachment point for straps so that the golf bag is very comfortable for the user.

An additional object of the present invention is to present an extension handle which is ergonomically designed to work with the straps to minimize fatigue of the user.

A further object of the present invention to present a strap system for a golf bag which allows the golfer to have his hands free while carrying the bag.

Briefly, one preferred embodiment of the present invention is an extension handle for a golf bag having a top opening, and carrying straps. The extension handle includes one or more brackets attached to the golf bag near the top opening, the brackets having attachment points for attachment of golf bag straps, which extend beyond said top opening of the bag. The extension handle includes a handle attached to the bracket or brackets.

Also a golf bag having an extension handle.

An advantage of the present invention is that the present golf bag with extension handle is very adaptable to a large variety of users.

Another advantage of the present invention is that balance and weight distribution of the golf bag is improved by used of the present invention.

And another advantage of the present invention is that by aligning the center of gravity of the bag with the user's body, weight is distributed more evenly on the user's shoulders.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
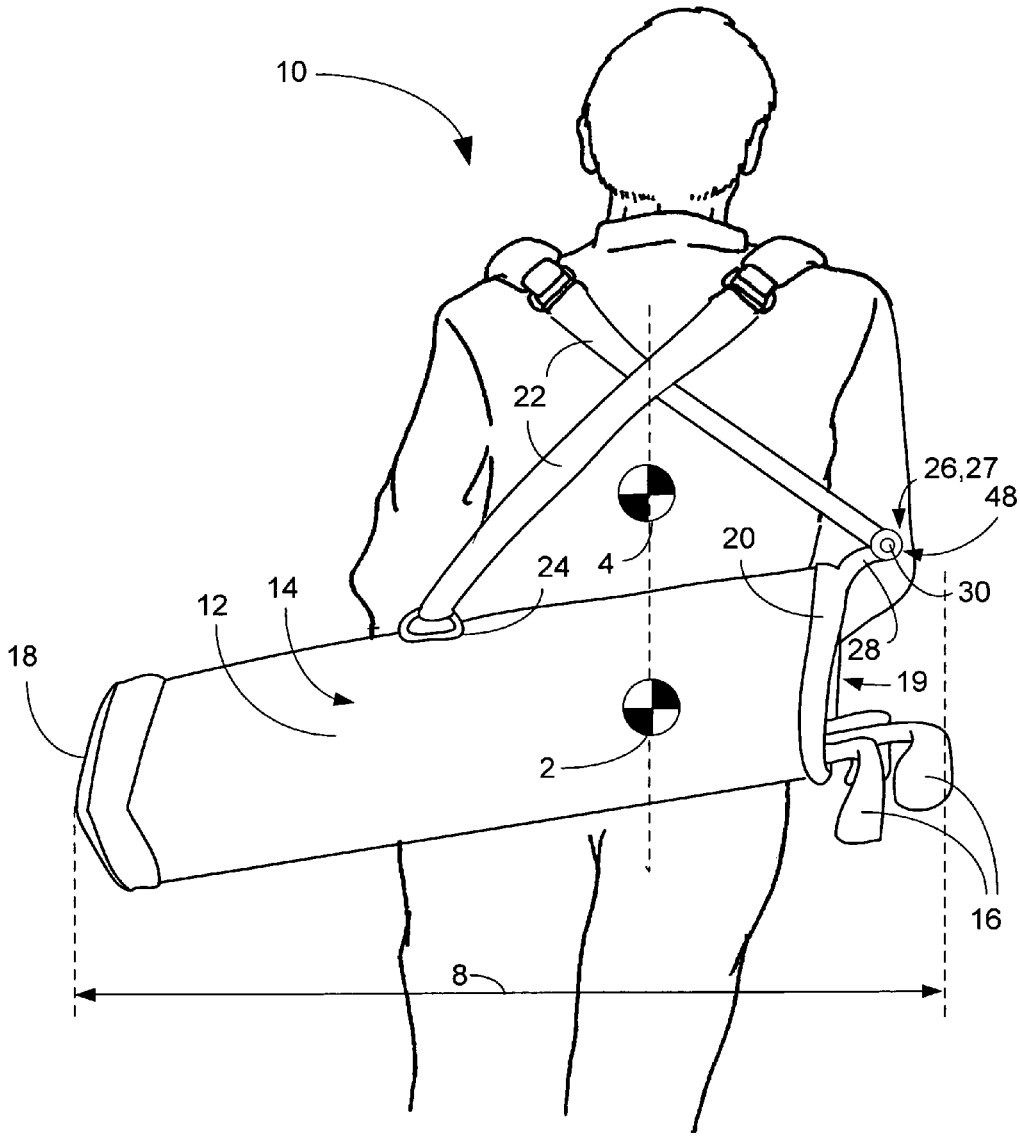
FIG. 1 shows the golf bag with extension handle of the present invention, showing the alignment of centers of gravity of the bag and the user.

A preferred embodiment of the present invention is a golf bag with extention handle. As illustrated in the various drawings herein, and particularly in the view of FIG. 1, a form of this preferred embodiment of the inventive device is depicted by the general reference character 10.

FIGS. 1, and 4–11 illustrate a golf bag having an enclosure or main body 14 for holding golf clubs 16. The golf bag includes a bottom 18, a top opening 19 and top collar 20. Straps 22 are shown which attach to attachment rings 24 for carrying the golf bag. These straps are preferably of the "X-strap" configuration such as shown in Des 411,039 to Reimers et al., but this is not a requirement.

Referring now particularly to FIGS. 5–9, the extension handle 26 of the present invention is preferably a rotatable extension handle 27, and includes a top collar 20 and preferably two brackets 28 preferably attached to or formed from a portion of the top collar 20. The two brackets 28 are preferably joined by an axle 30. This axle 30 is surrounded by a handle 36 having a grip 32, which preferably, but not necessarily, is free to rotate about the axle 30 to form the rotatable extended handle 27. The ends of the axle 30 preferably serve as an attachment point 48 for one of the straps 22, which also preferably are free to rotate at their point of attachment, perhaps by being threaded onto the axle 30 as well, with a washer or retainer 34 of some sort on the ends of the axle 30 to keep them from sliding off. The grip 32 may have a texture area 46 included which allows the user to maintain a better grasp on the handle 36.

The extension handle 26 may be configured as a portion of the top collar 20, as shown or may be an attachment to it. In either case, the extension handle 26 includes at least one bracket 28 which is attached in fixed relation to the golf bag 12. For purposes of this patent application, the phrase "in fixed relation" shall mean that the brackets 28 neither translate nor rotate with regard to the golf bag 12, and thus form a rigid extension.

In use, the extension handle 26 serves a double purpose. It first provides an attachment point 48 for the strap 22 which serves to shift the center of gravity of the golf bag 12 closer to the center of the user's back. Since much of the weight of the golf clubs lies in the heads of the clubs, the center of gravity of the bag is generally farther to the right when seen from behind than the half-way point of the length of the bag. By adding the extension frame 26 to the bag 10, the center of gravity 2 is shifted to the left as seen from behind, towards the center of gravity of the user's back 4, as seen in FIG. 1. This alignment of centers of gravity 2, 4 makes an important improvement in the "feel" of the bag, since it will tend to swing less and will tend less to pull the user to the side. This is to be contrasted by the use of the bag of the prior art (FIG. 2) which shows that the center of gravity of the bag 2 is misaligned with the center of gravity of user 4 and is displaced by a displacement amount 6. It is to be understood that no attempt has been made to draw the bag, extension and user in exact proportions to each other or with exact proportional dimensions, and FIGS. 1 and 2 are intended to show the relative positions of the centers of gravity of the bags with respect to users of the two bags only.

Figure 2:
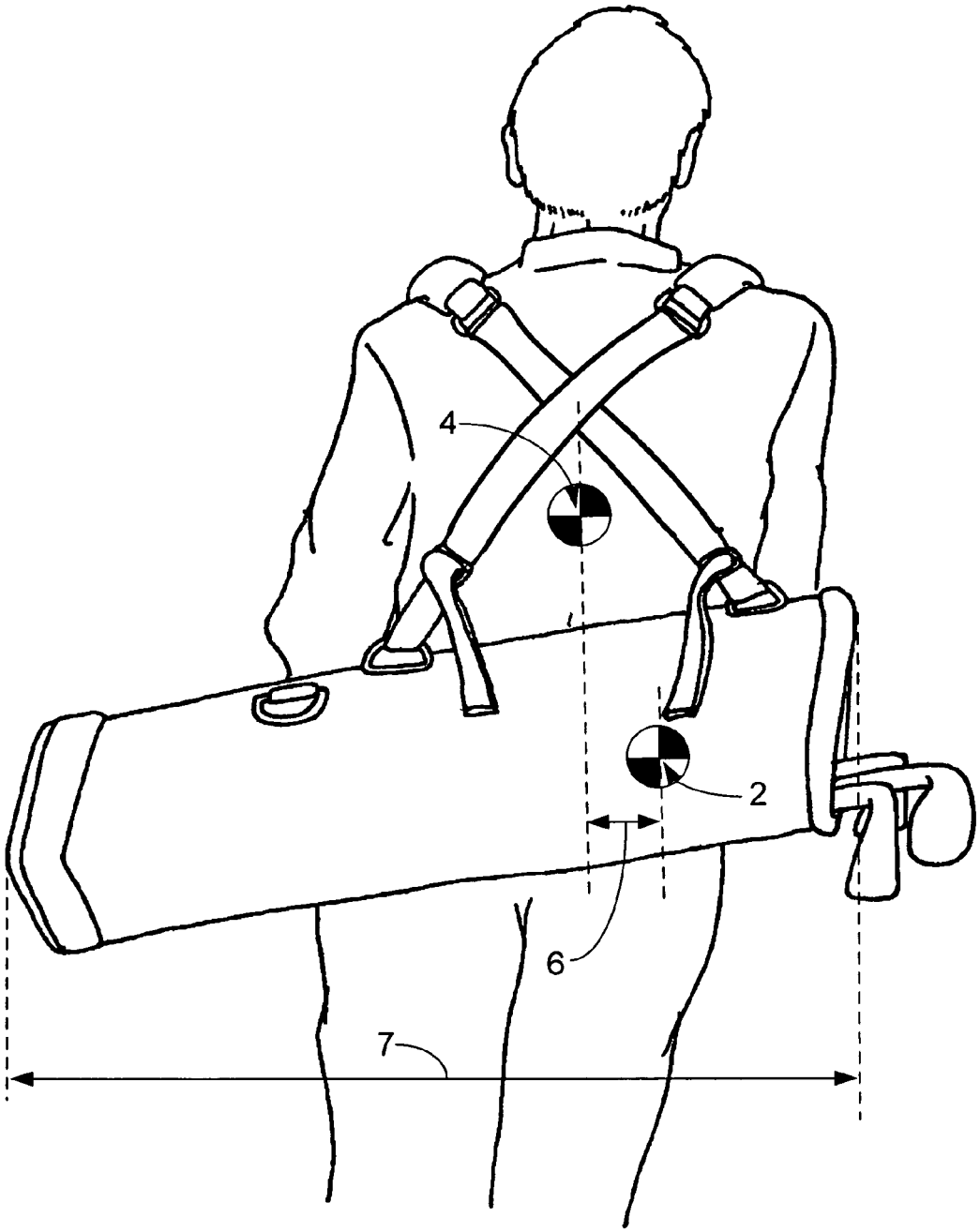
FIGURE 2 (Prior art)
FIG. 2 shows a golf bag of the prior art with the misalignment of centers of gravity of the bag and the user.
Figure 4:
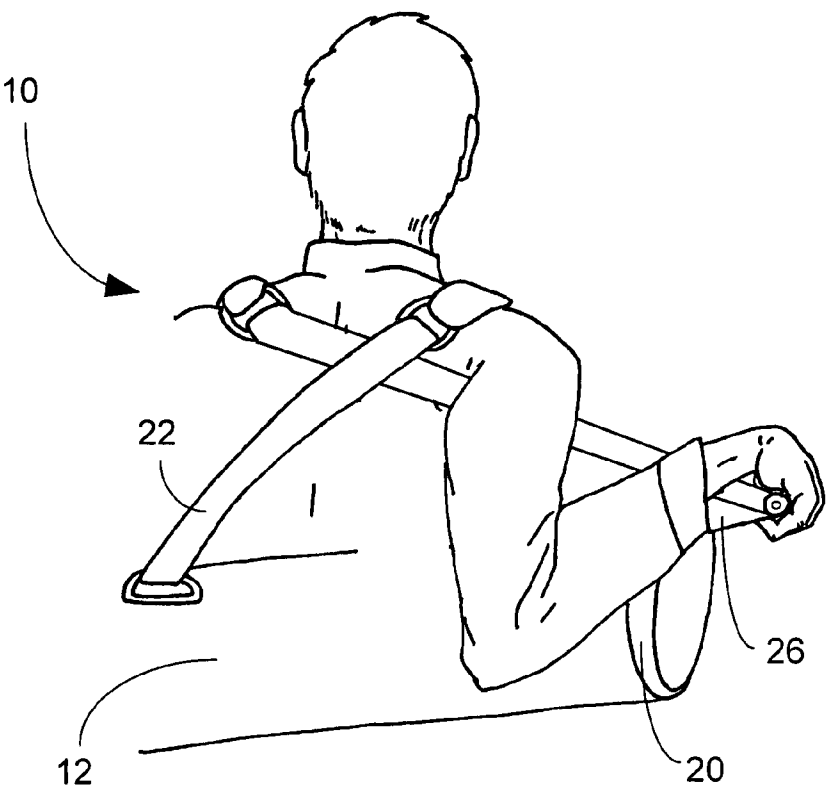
FIG. 4 shows a user of a golf bag with extension handle dismounting it in a more comfortable manner.

Putting it another way, a typical bag has a regular bag length 7, as seen in FIG. 2 (Prior art). This length is typically determined by the length of the golf clubs and is usually standardized to allow easy access to the clubs and to minimize bulk and weight of material. As seen in FIG. 1, the extension handle 26 creates an extended bag length 8 without adding substantial weight and bulk to the bag. By then using this extended length 8 as the basis for the attachment points 48 of the straps 22, the center of gravity 2 is more closely aligned with the center of gravity of the user 4.

Figure 3:
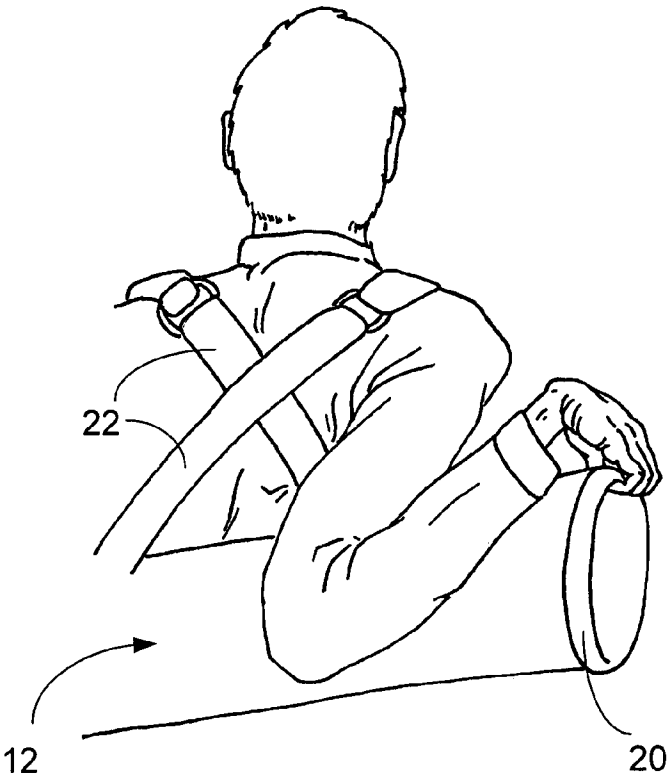
FIGURE 3 (Prior Art)
FIG. 3 shows a user of a golf bag of the prior art attempting to dismount it by utilizing the "goose neck grip"
Figure 5:
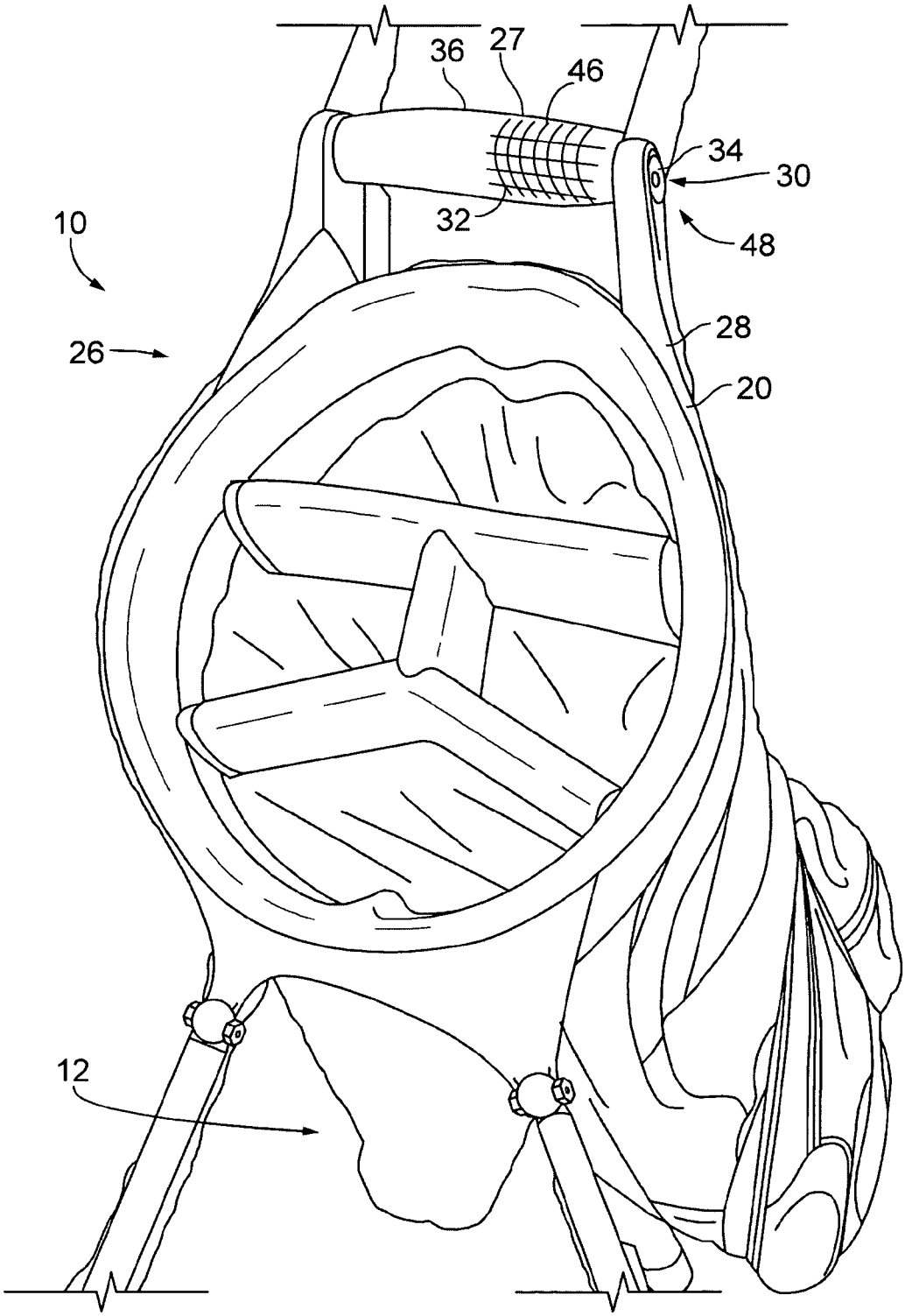
FIG. 5 illustrates a top perspective view of the upper portion of a golf bag with extension handle of the present invention.
Figure 6:
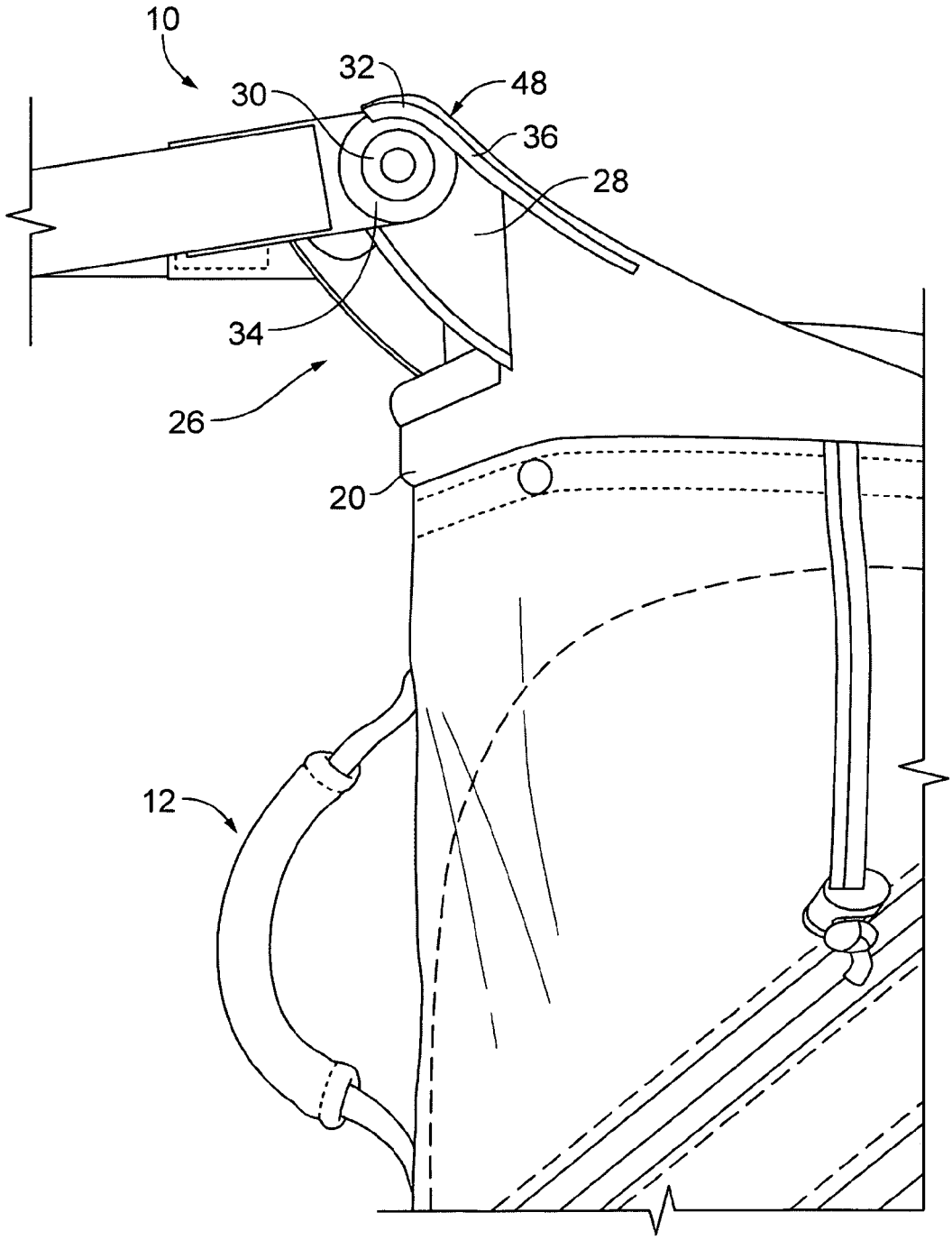
FIG. 6 illustrates a side view of the upper portion of a golf bag with extension handle of the present invention.
Figure 7:
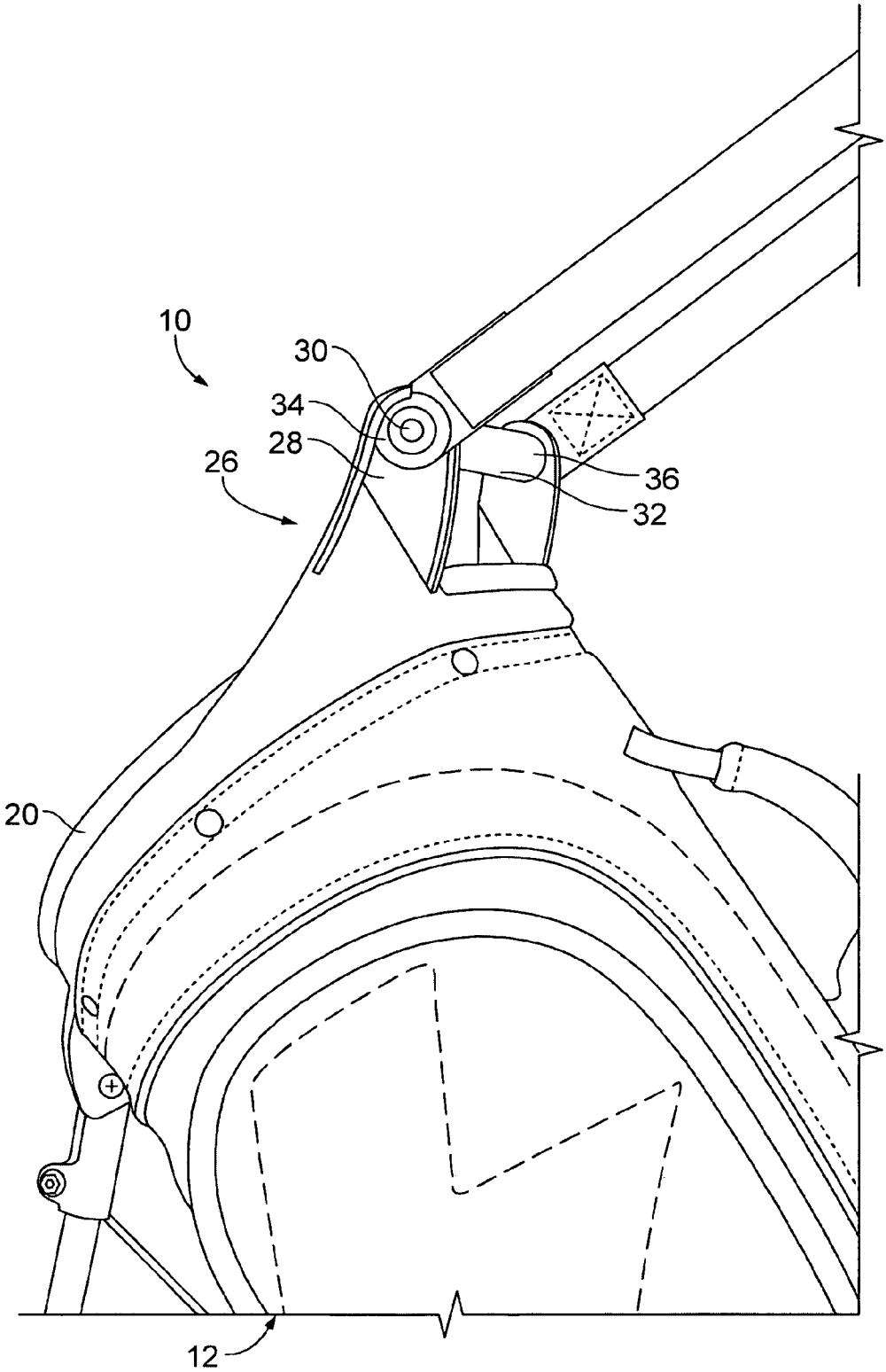
FIG. 7 shows a side perspective view of the upper portion of a golf bag with extension handle of the present invention.
Figure 8:
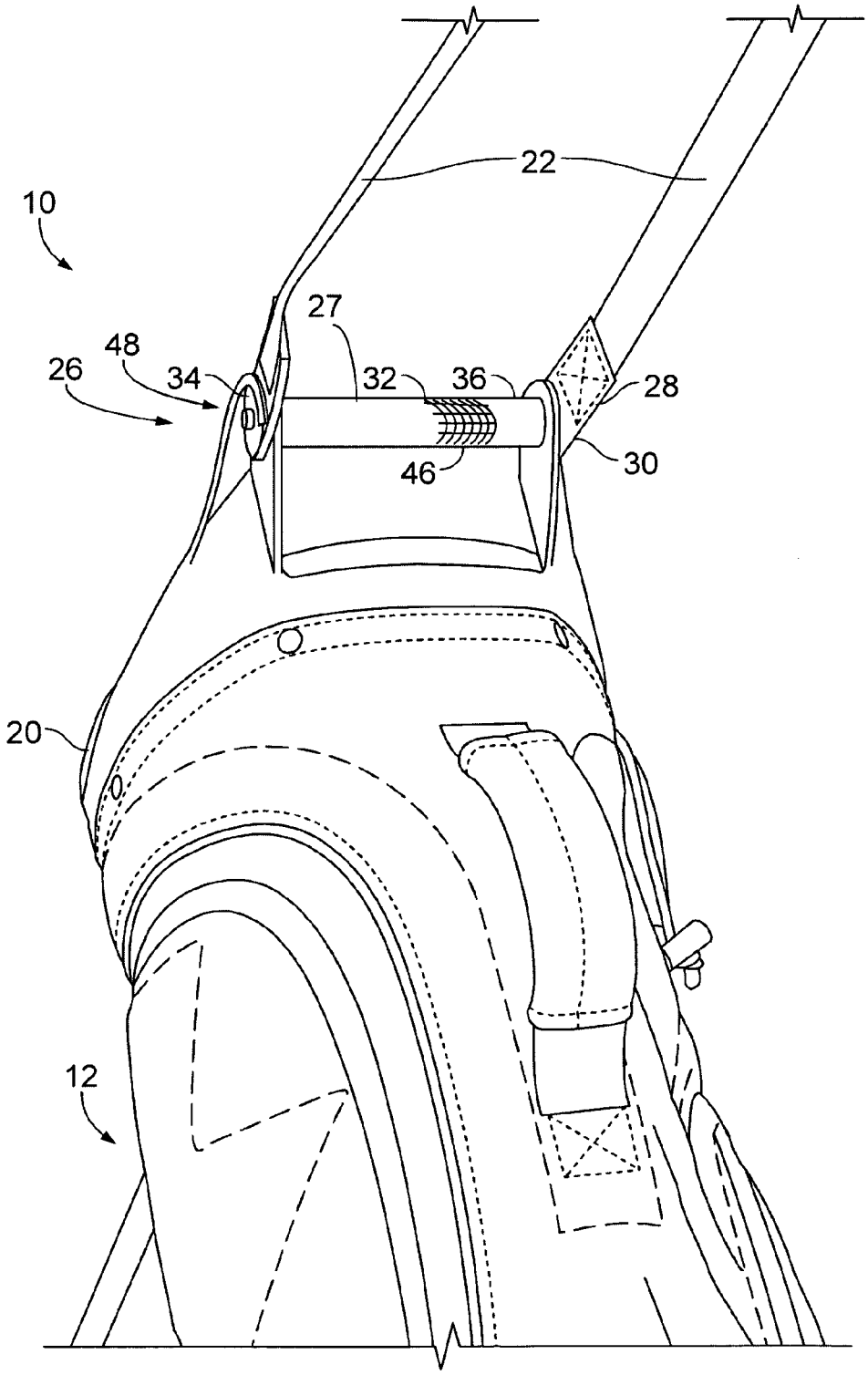
FIG. 8 illustrates a rear view of the upper portion of a golf bag with extension handle of the present invention.
Figure 9:
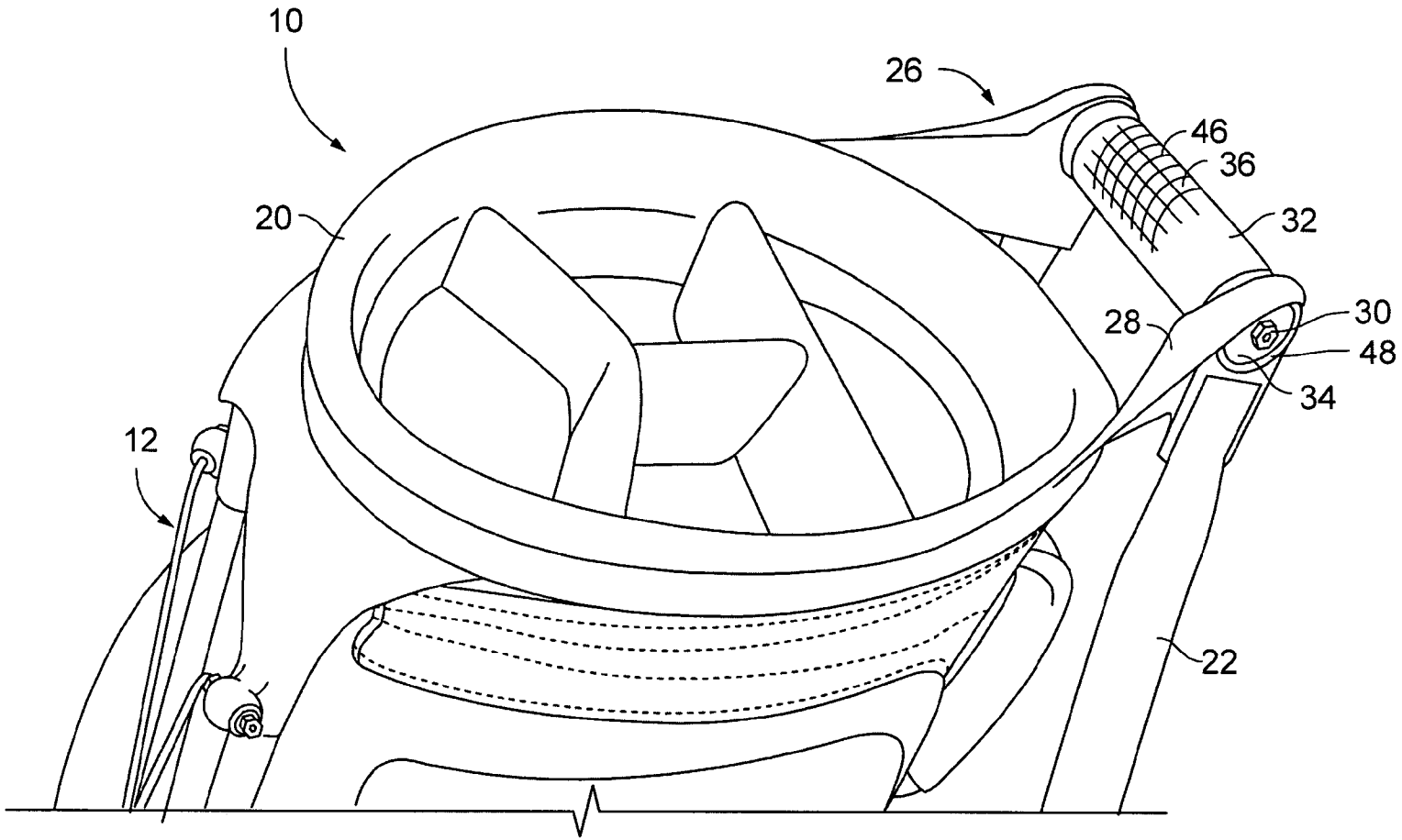
FIG. 9 illustrates a top perspective view of the upper portion of a golf bag with extension handle of the present invention.

The second purpose of the extension handle 26 is to provide a grip for the user when mounting and especially dismounting the bag from his back. As golfers routinely mount and dismount their golf bags from their backs in order to access their clubs, it is the common practice for the golfers to reach around behind themselves to grasp whatever portion of the bag is reachable by their hands to swing the bag into an upright position while they shrug their way out of the straps. Bags are generally set up so that the opening at the bag's top is located on the right hand side of a right-handed user, so that the right hand may reach back and grasp a portion of the bag. As described above, this is usually done by using the "goose neck grip" as it has been called to insert the user's fingers into the bag opening and then pinch which the thumb to grasp the upper portion of the golf bag. This grip is shown in FIG. 3 (prior art), and involves an awkward and potentially painful contortion where the user must pull his elbow as far as possible behind him, arch his wrist to a nearly painful degree, and then attempt to grasp the bag's opening and support it, which may weigh as much as 35 lbs when loaded, in this goose neck grip, while struggling out of the straps.

In contrast, the user of the present invention 10 has much easier access to the grip 32 which serves as a handle 36. Since the handle 36 is located farther to the right, as seen from behind, than the unextended top collar of a conventional bag, the user does not need to contort so much to grasp it, the elbow does not need to contort so far behind the user's back to allow the user's hand proximity to the top collar, and the user does not need to execute such an extreme goose neck grip to grasp the handle. In addition, by having a rounded grip 32, the user's hand does not need to pinch the bag 12, but rather is able to obtain a strong and comfortable grip by which to manipulate the bag 12. By having the handle optionally rotatable about the axle 30, the user does not need to release his grip and re-grip the handle as the bag changes angles while the user dismounts it. Instead, the bag 12 is allowed to pivot, and the user retains his same grip throughout the process of removal.

Figure 10:
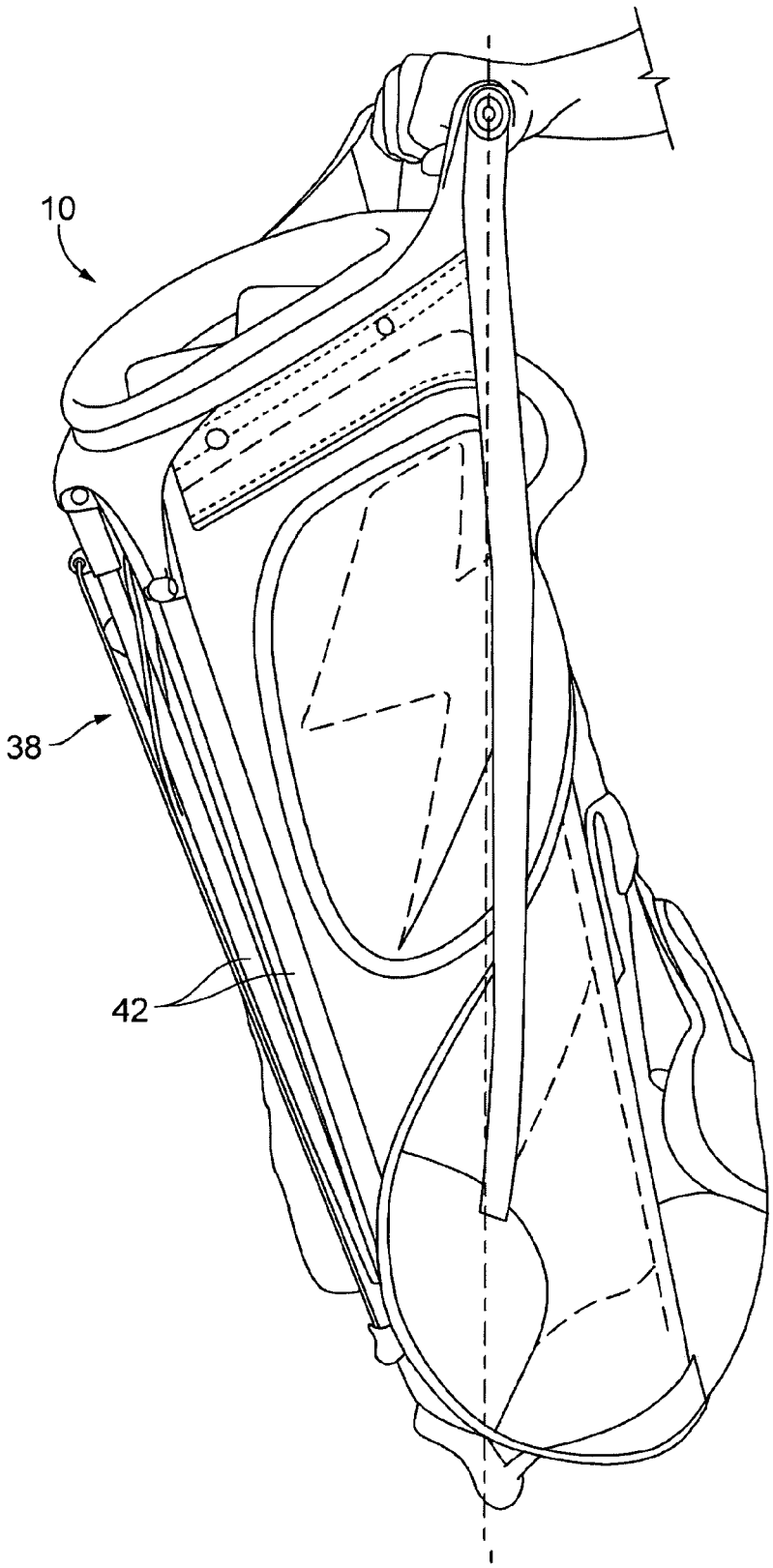
FIG. 10 shows a side perspective view of a golf bag having a built-in stand, the golf bag having the legs in a retracted position.
Figure 11:
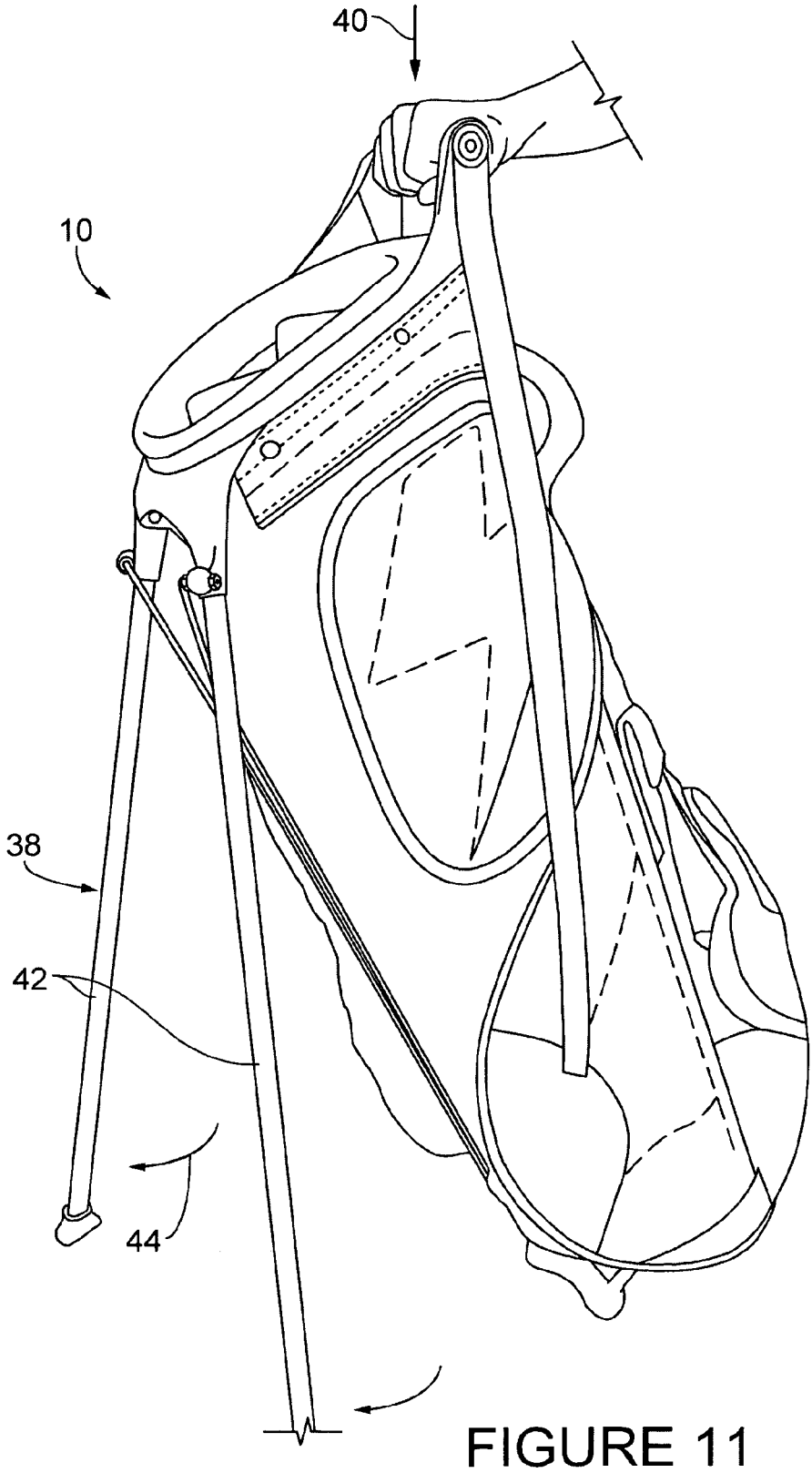
FIG. 11 illustrates a side perspective view of a golf bag having a built-in stand, the golf bag having the legs in an extended position.

FIGS. 10 and 11 show full length views of the golf bag with extendable handle 10 which has a built-in stand 38, such as shown in U.S. Pat. No. 5,762,189 to Reimers. The extension handle 26 of the present invention works particularly well with this style of golf bag, since the handle 36 provides a solid, non-yielding point for application of downward pressure 40 to the pressure-activated stand, thus forcing the legs 42 out as shown by the arrows 44 in FIG. 11. The dismounting of the bag 10 can thus assume a single flowing series of motions, whereby the user grasps the handle 36, allowing the straps to fall from his shoulders, swinging the bag out in front of his body, clear of the his legs, where the stand is then activated by downward pressure of the same hand which grips the handle 36, and without changing the hand's grip. The freely rotating nature of the handle 36 on the axle 30 means that the golfer does not need to readjust his grip. The bag smoothly proceeds from its mounted position on the golfer's back to it finally position on its activated stand 38 all in one motion.

It is also easy for left handed golfers to use this golf bag 10, as they can change the orientation of the straps to the clubs and the handle to be on the left side.

While various embodiments have been described above, it should be understood that they have been presented by way of example only, and not limitation. Many further variations are possible, which will be obvious to one skilled in the art. For example, although a pair of brackets is preferred, it is also possible that a single bracket be used in conjunction with the axle and handle. The brackets may be part of, or attached to, the top collar, but they may also be attached to the main body 14 of the bag by some other structure or mechanism, and there may be no collar at all. Likewise the grip 32 and texture area 46 may have variations, so for example the grip could be contoured like a bicycle grip, etc, or may be an essentially featureless cylinder as shown. Also, as referred to above, it is preferred that the handle be rotatable, but not necessary. For example, the handle may be mounted to one or both brackets by screw threads.

Thus, the breadth and scope of a preferred embodiment should not be limited by any of the above described exemplary embodiments, but should be defined only in accordance with the following claims and their equivalents.

INDUSTRIAL APPLICABILITY

The present golf bag with extension handle 10 is well suited for the recreational activity of golf.

In use, the extension frame 26 serves a double purpose. It first provides an attachment point 40 for the strap 22 which serves to shift the center of gravity of the golf bag 12 closer to the center of the user's back. The extension handle 26 creates an extended bag length 8 without adding substantial weight and bulk to the bag. By then using this extended length 8 as the basis for the attachment points 40 of the straps 22, the center of gravity 2 is allowed to align with the center of gravity of the user 4.

The golf bag with extension handle 10 also provides a grip for the user when mounting and especially dismounting the bag from his back. As golfers routinely mount and dismount their golf bags from their backs in order to access their clubs, it is the common practice for the golfers to reach around behind themselves to grasp whatever portion of the bag is reachable by their hands to swing the bag into an upright position while they shrug their way out of the straps. Bags are generally set up so that the opening at the bag's top is located on the right hand side of the user, so that the right hand may reach back and grasp a portion of the bag. As described above, this is commonly done by using the "goose neck grip", which involves an awkward and potentially painful contortion where the user must pull his elbow as far as possible behind him, arch his wrist to a nearly painful degree, and then attempt to grasp the bag's opening and support it, in this goose neck grip, while struggling out of the straps. Alternatively, a user may grab the straps to dismount the bag, commonly causing the bag to swing or gyrate as it dangles from the straps. This makes activation of a built-in stand difficult, as the bag must be steadied, and then aligned properly to activate the stand device.

In contrast, the user of the present invention 10 has much easier access to the grip 32 which serves as a handle 36. Since the handle 36 is located farther to the right, as seen from behind, the user does not need to contort so much to grasp it, the elbow does no need to contort so far behind the user's back to allow the user's hand proximity to the top collar, and the user does not need to execute such an extreme goose neck grip to grasp the handle. In addition, by having a rounded grip 32, the user's hand does not need to pinch the bag, but rather is able to obtain a strong and comfortable grip by which to manipulate the bag. By having the handle rotatable about the axle 30, the user does not need to release his grip and re-grip the handle as the bag changes angles while the user dismounts it. Instead, the bag is allowed to pivot, and the user retains his same grip throughout the process of removal.

The extension handle 26 of the present invention works particularly well with golf bags having built-in pressure-activated stands 38, since the handle 36 provides a solid, non-yielding point for application of downward pressure 40 to activate the stand, thus forcing the legs 42 out. The dismounting of the bag 10 can thus assume a single flowing series of motions, whereby the user grasps the handle 36, allowing the straps to fall from his shoulders, allowing the bag to swing out in front of his body, clear of the golfer's legs, where the stand is then activated by downward pressure of the same hand which grips the handle 26. The freely rotating nature of the handle 36 on the axle 30 means that the golfer does not need to readjust his grip. The bag smoothly proceeds from its mounted position on the golfer's back to it finally position on its activated stand 38 all in one motion.

For the above, and other, reasons, it is expected that the golf bag with extension handle 10 of the present invention will have widespread industrial applicability. Therefore, it is expected that the commercial utility of the present invention will be extensive and long lasting.

What is claimed is:

1. A golf bag system comprising:

a golf bag having a main body and top, said golf bag having a length and an effective center of gravity;

carrying straps for carrying said golf bag on the shoulders of a user, said carrying straps having opposing ends and being attached at one end to said golf bag at locations opposite said center of gravity from said top; and an extension handle extending beyond said top of said bag to provide a solid, non-yielding point therewith, said extension handle including a grip which is aligned to be generally perpendicular to said length of said golf bag, wherein said extension handle provides attachment points for the ends of said straps at locations on the same side of said center of gravity of said bag as said top and beyond said bag top, thereby effectively extending said length.

2. The golf bag system of claim 1 and further including an axle formed within said extension handle, said axle providing for rotation of said grip thereon.

3. The golf bag system of claim 2 and further including a texture area formed on said grip to enhance grasping.

4. The golf bag system of claim 1 wherein said extension handle is formed by a pair of brackets extending from said top of said bag, each said bracket having an outer end, with said grip being mounted between the ends of said brackets and said strap ends being attached to the outer sides of said ends of said brackets.

5. The golf bag system of claim 1 wherein said carrying straps include two straps for extending over both shoulders of the user.

* * * * *